US005099656A

United States Patent [19]

Martineau

[11] Patent Number: 5,099,656

[45] Date of Patent: Mar. 31, 1992

[54] EVAPORATOR DESIGN

[75] Inventor: Tom N. Martineau, Erie, Pa.

[73] Assignee: Uniflow Manufacturing Company, Erie, Pa.

[21] Appl. No.: 645,824

[22] Filed: Jan. 25, 1991

[51] Int. Cl.[5] ..... F25C 5/10

[52] U.S. Cl. ..... 62/347; 62/352; 165/160; 165/162

[58] Field of Search ..... 62/352, 347, 348; 165/160, 162

[56] References Cited

U.S. PATENT DOCUMENTS

| | | | |
|---|---|---|---|
| 2,618,129 | 11/1952 | Williams | 62/352 X |
| 2,721,452 | 10/1955 | Brandin et al. | 62/352 X |
| 2,956,787 | 10/1960 | Raub | 165/162 X |
| 3,206,545 | 9/1965 | Nelson et al. | 62/352 |
| 3,280,585 | 10/1966 | Lowe | 63/347 |
| 4,378,680 | 4/1983 | Garland | 62/352 |

*Primary Examiner*—William E. Tapolcai
*Attorney, Agent, or Firm*—Charles L. Lovercheck; Wayne L. Lovercheck

[57] ABSTRACT

A refrigeration evaporator comprising an enclosure having a closed top and bottom, enclosing a separator plate, lower baffle, and an upper baffle in the enclosure and spaced from one another to define a hot gas chamber, a refrigerant inlet area, a freezing chamber and a refrigerant outlet area. The evaporator is adapted to be connected to a refrigeration circuit having a freezing cycle and a harvest cycle wherein cold liquid refrigerant is directed into the freezing chamber during the freezing cycle, but prevented from entering the hot gas chamber; and hot gas is directed into the hot gas chamber and then into the freezing chamber during the harvest cycle. Water pipes extend vertically through the evaporator and through holes in the upper and lower baffles. The holes in the baffles are larger than the water pipes to provide a flow path around the water pipes for refrigerant, and the holes in the upper baffle are larger than the holes through the lower baffle thereby providing a larger cross sectional area flow path thereby decreasing the pressure drop of the refrigerant flowing through the freezing chamber. Filler rods are placed between the water pipes partially filling the space to provide more heat transfer area and to reduce the volume of refrigerant in the system.

18 Claims, 8 Drawing Sheets

EVAPORATOR DESIGN

BACKGROUND OF THE INVENTION

This invention relates to an improved ice making machine having an evaporator with water pipes extending vertically therethrough and open through the top and bottom thereof. The evaporator is divided into a relatively large freezing chamber and a relatively small hot gas inlet chamber below the freezing chamber. Low pressure liquid refrigerant is fed into the evaporator at the bottom of the freezing chamber and gas refrigerant is drawn off at the top of the freezing chamber to freeze water flowing through the water tubes. When the tubes are almost filled with ice, hot gas is introduced from the hot gas inlet chamber to the bottom of the freezing chamber to warm the water tubes and release the ice so it will slide out for harvesting.

It is known in the prior art to include a short separate chamber at the bottom of the freezing chamber through which warm liquid refrigerant flows before continuing through the refrigeration circuit to the expansion valve. The warm liquid refrigerant passing through this chamber prevents excess ice build up at the lower ends of the water tubes, and thus, avoids difficulty in obtaining release of the ice when the hot gas is introduced through the side of the evaporator near the bottom of the freezing chamber. This small chamber also acts to cool the warm liquid refrigerant before it enters the expansion valve during the freezing period.

SUMMARY OF THE INVENTION

The present invention relates to refrigeration evaporators and more particularly to a vertical evaporator.

This invention provides an evaporator having a freezing chamber having three areas: a refrigerant receiving area to receive refrigeration fluid from a condensing unit for freezing water, a freezing area within which most of the ice is formed, and a refrigerant outlet area, within which the refrigerant gas flows to the refrigerant outlet pipe. A lower chamber below the refrigerant receiving area is provided for receiving hot gasses for melting ice to release the ice columns from the pipes during harvest.

Water pipes extend from the bottom of the evaporator to the top and extend through the lower section, then through enlarged holes in the lower baffle separating the refrigerant inlet area from the freezing area. The water pipes also extend from the freezing area to the refrigeration outlet area. An upper baffle may be provided to separate the freezing area from the refrigerant outlet area. When an upper baffle is provided, the holes in the upper baffle are larger than the holes in the lower baffle to provide a larger area flow path through the upper baffle than through the lower baffle and therefore reduce the pressure drop through the evaporator.

Liquid refrigerant fills the freezing area and evaporates. This type of evaporator is commonly called a flooded evaporator. The refrigerant evaporates in the freezing area which produces the "freezing effect" upon the water.

Filler rods, which may be made of aluminum, are packed between the water pipes which provides heat transfer means between the refrigeration liquid and the water pipes and also to restrict the cross sectional area of flow space between the pipes, thereby increasing the flow rate of refrigeration material through the freezing area, reducing the volume of the area, reducing the amount of refrigeration materials necessary, reducing the amount of oil separation from the refrigerant and to aid in the coefficient of heat transfer.

The lower chamber has typically been used as a "sub-cooling" chamber for liquid refrigerant (between the condenser and expansion valve).

In this invention, the lower chamber is not utilized as a refrigerant sub-cooling chamber as it has been used in the prior art. Efficiency in operation is gained by making the lower chamber into a distributor for hot gasses during harvest. By keeping the liquid refrigerant from entering the lower chamber during the freezing mode of the operation, the ice build-up in the bottom of the water pipes remains a safe distance from the ends of the pipes. Thus, to harvest the ice hot gas is fed into the lower chamber and from there into the freezing chamber. The water pipes are warmed sufficiently for the ice to be released from the water pipes without delay. A purpose of the present invention is to keep the bottom area of the water pipes from freezing in order to be able to harvest the ice efficiently.

Applicant has also provided an improved way of keeping refrigerant from entering the lower chamber during the freeze mode of the operation as follows: a standpipe configuration has been provided which will not allow the liquid refrigerant to run down into the lower chamber. Thus, hot gas may be fed into the bottom chamber and through the standpipes and into the freezing area when harvesting the ice in order for the hot gas to release ice from the water pipes. The standpipe structure may be provided inside the enclosure or, in the alternative, it may be provided external to the enclosure. In another embodiment of the invention, a check valve may be provided in a port in the separator plate, or a check valve may be provided external to the evaporator and connected to the hot gas chamber and the freezing area by pipes.

It is an object of the invention to provide an improved evaporator for an ice making machine.

Another object of the invention is to provide an improved design of evaporators.

Another object of the invention is to provide an evaporator for an ice making machine that is simple in construction, economical to manufacture and simple and efficient to use.

Another object of the invention is to provide an improved method of freezing ice.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

DESCRIPTION OF THE PREFERRED EMBODIMENTS

Figure 1:
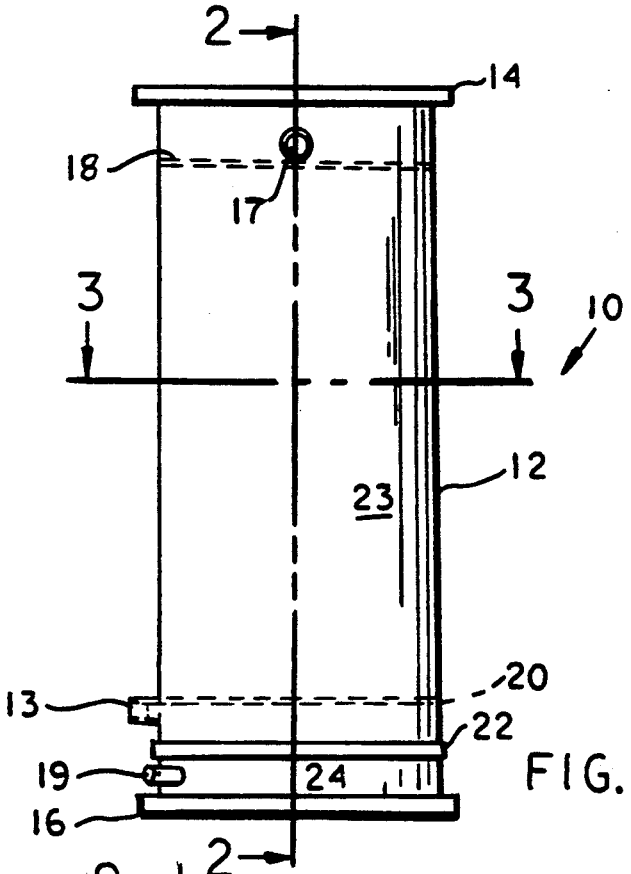
FIG. 1 is a front view of the evaporator according to the invention.
Figure 2:
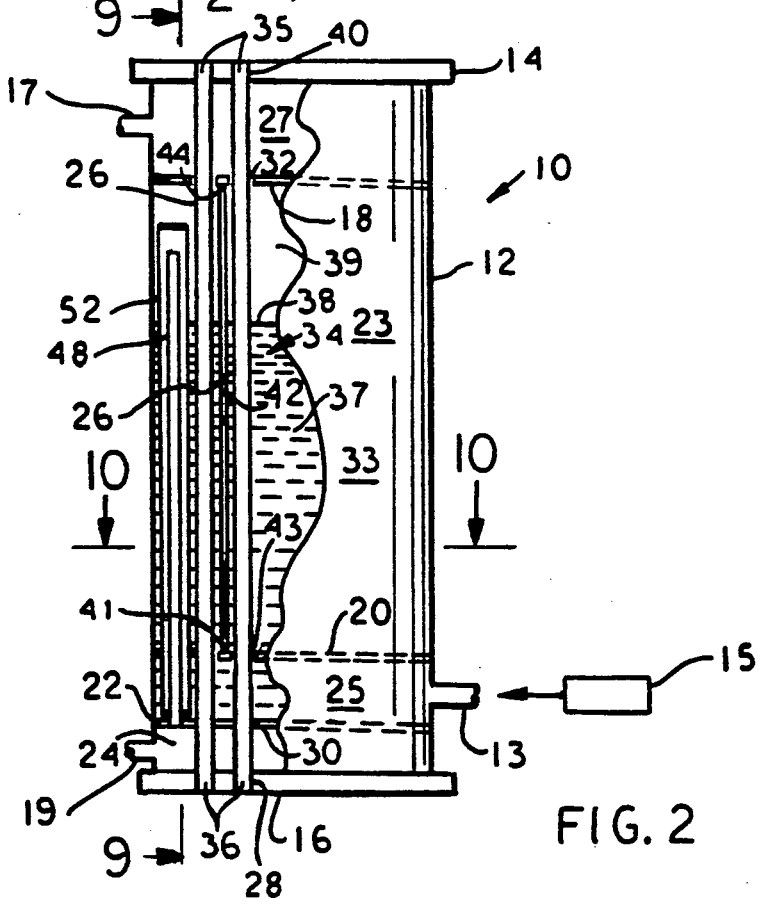
FIG. 2 is a front view taken of the evaporator with part of the enclosure broken away.

Now with more particular reference to the drawings, evaporator 10 has enclosure 12, in the form of a tank which may be in the form of an upright hollow cylinder, having refrigerant inlet 13 for receiving refrigerant from expansion valve 15 of a refrigeration system. Enclosure 12 has top end 14, bottom end 16 and separator plate 22. Enclosure 12 may also have upper baffle 18 and lower baffle 20. Bottom end 16 and separator plate 22 define hot gas chamber 24 which receives hot gas through hot gas inlet 19. Top end 14 and separator plate 22 define freezing chamber 23. The lower end of freezing chamber 23 acts as refrigerant receiving area 25. Refrigerant is introduced through refrigerant inlet 13 and distributed across the area of freezing chamber 23 in refrigerant receiving area 25. When lower baffle 20 is used, separator plate 22 and lower baffle 20 define refrigerant receiving area 25. When upper baffle 18 and lower baffle 20 are used, the space between lower baffle 20 and upper baffle 18 define freezing area 33. The upper end of freezing chamber 23 acts as refrigerant outlet area 27. Refrigerant is collected and exits enclosure 12 through refrigerant outlet 17. When upper baffle 18 is used, the space between upper baffle 18 and top end 14 define refrigerant outlet area 27. Freezing chamber 23 is filled with refrigerant 34. Liquid refrigerant 37 is concentrated in the lower part of freezing chamber 23, while the refrigerant is almost 100% gases 39 at the top of freezing chamber 23 creating an "effective" liquid refrigerant level 38. Above liquid refrigerant level 38 the freezing chamber is effectively filled with gas refrigerant 39.

Water pipes 26 are provided which may be made out of stainless steel, for example. Water pipes 26 have inlet end 35 at top end 14 of enclosure 12 and outlet end 36 at bottom end 16 of enclosure 12. Water pipes 26 extend through first holes 28 in bottom end 16, then pass through second holes 30 in separator plate 22, through third holes 43 in lower baffle 20, through fourth holes 32 in upper baffle 18 and through fifth holes 40 in top end 14. At bottom end 16, water pipes 26 engage the sides of first holes 28, second holes 30 and fifth holes 40 in refrigerant tight relationship. Water pipes 26 are secured by brazing or other suitable fastening means. At lower baffle 20 and upper baffle 18, water pipes 26 do not engage the sides of third holes 43 and fourth holes 32.

Third holes 43 and fourth holes 32 are slightly larger than the outside diameter of water pipes 26 to provide a path for the flow of refrigerant 34. Fourth holes 32 are larger than third holes 43 in order to provide a larger path area and thereby reduce the pressure drop of refrigerant 34 flowing from refrigerant freezing area 33 to refrigerant outlet area 27.

Figure 3:
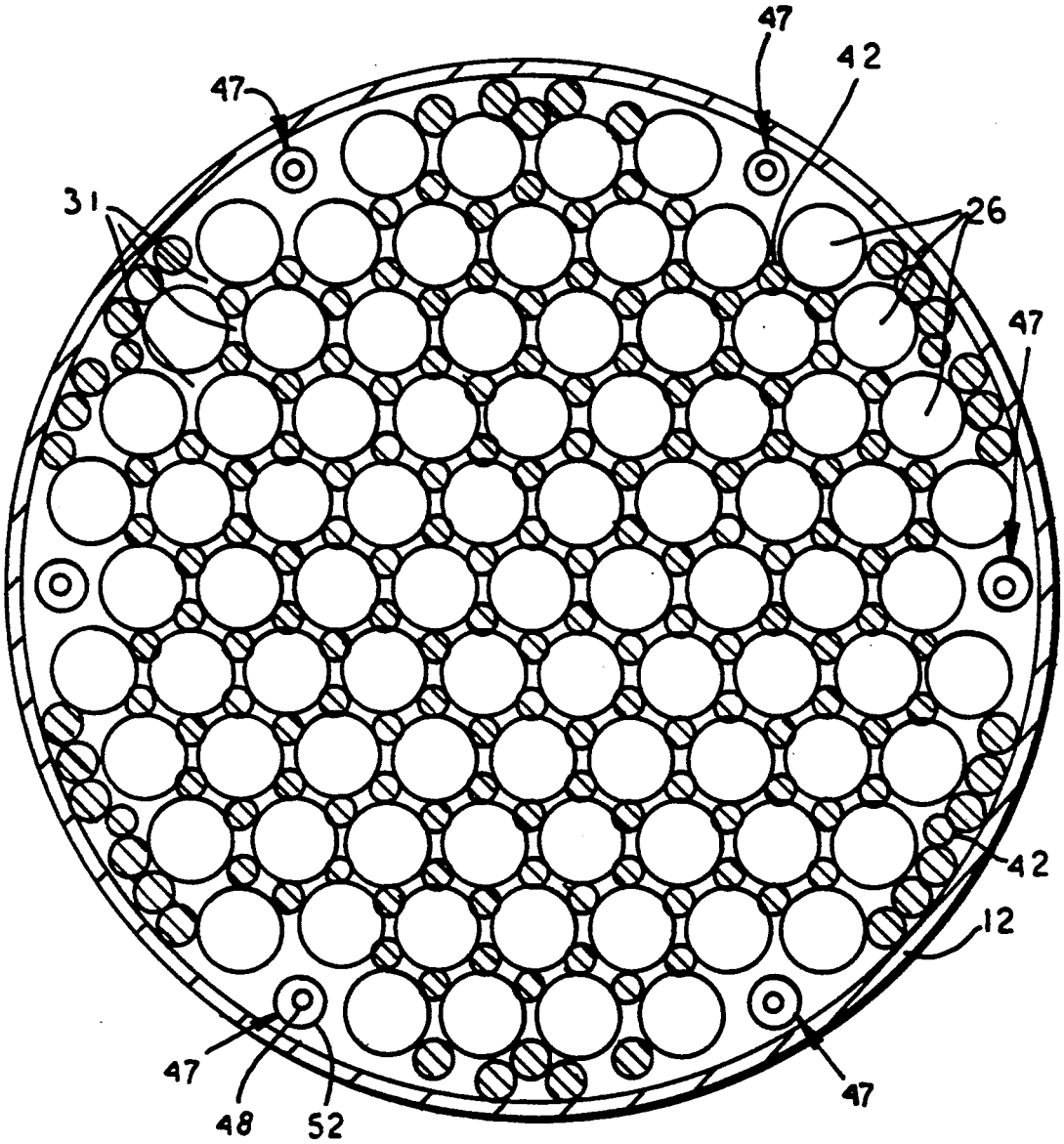
FIG. 3 is a cross sectional view taken on line 3—3 of FIG. 1.

Filler rods 42 are packed between water pipes 26 as shown in FIG. 3. Filler rods 42 generally are of the same diameter to facilitate the packing of water pipes 26 and filler rods 42 in enclosure 12. However, filler rods of different diameters can be used effectively to fill in around the circumference of enclosure 12. Filler rods 42 have lower ends 41 and upper ends 44. Filler rods 42 provide heat transfer means between refrigerant 34 and water pipes 26. Filler rods 42 may be made of aluminum or other suitable heat conductive material. Filler rods 42 also reduce the volume of the flow space between water pipes 26 which reduces the volume of refrigerant material necessary to operate evaporator 10 and increases refrigerant velocity through evaporator 10 which reduces the amount of oil separation from refrigerant. Filler rods 42 and water pipes 26 provide pathways 31 through freezing chamber 23. Thus, refrigerant 34 entering freezing chamber 23 is distributed across refrigerant receiving area 25 and enters pathways 31 and moves directly upwardly to refrigerant outlet area 27 where it exits through refrigerant outlet 17. Pathways 31 even the flow across freezing chamber 23 and eliminates dead spots where refrigerant flow may slow or stop resulting in increased oil separation from refrigerant 34.

Figure 10:
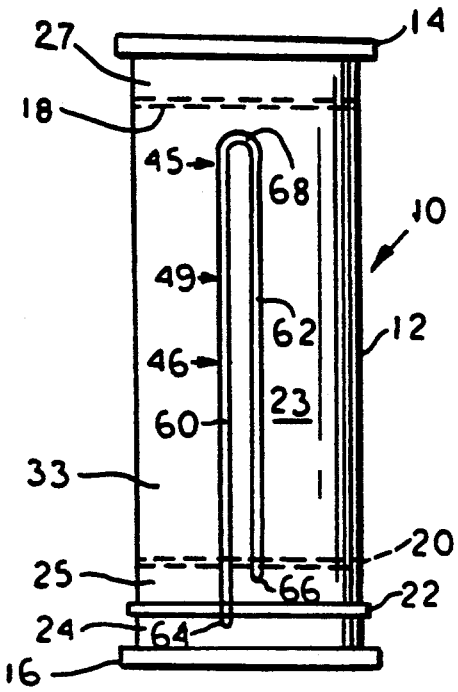
FIG. 10 is a front view of the invention showing the structure of the standpipe embodiment with the pipes external to the enclosure.
Figure 8:
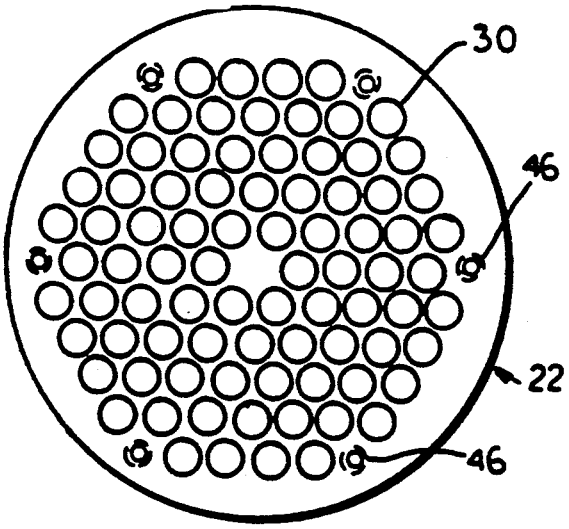
FIG. 8 is a top view of the separator plate.
Figure 11:
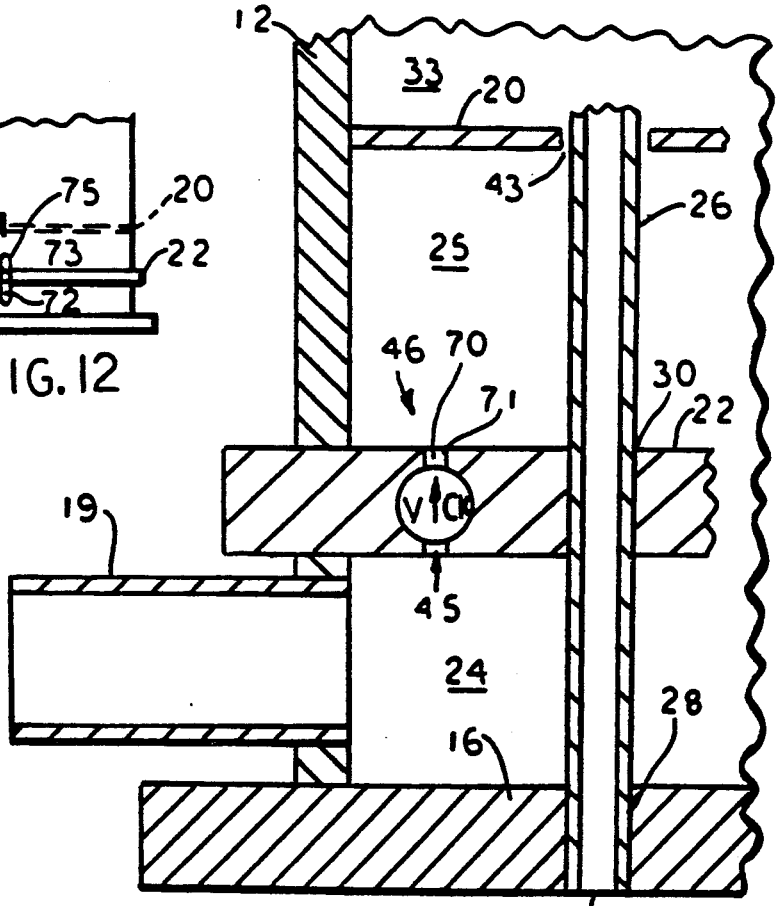
FIG. 11 is an enlarged partial cross sectional view taken on line 9—9 of FIG. 2 showing the internal check valve embodiment of the invention.

Evaporator 10 is provided with conducting means 46 for conducting the hot gas from hot gas chamber 24 to freezing chamber 23 and preventing means 45 for preventing liquid refrigerant 37 from flowing from freezing chamber 23 into hot gas chamber 24. Conducting means 46 may consist of one or more internal standpipes 47, external standpipes 49 as shown in FIG. 10, ports 71 with check valves 70 as shown in FIG. 11, or other suitable means to conduct the hot gas during harvest and prevent the back flow of the cold liquid refrigerant during the freezing period.

Figure 4:
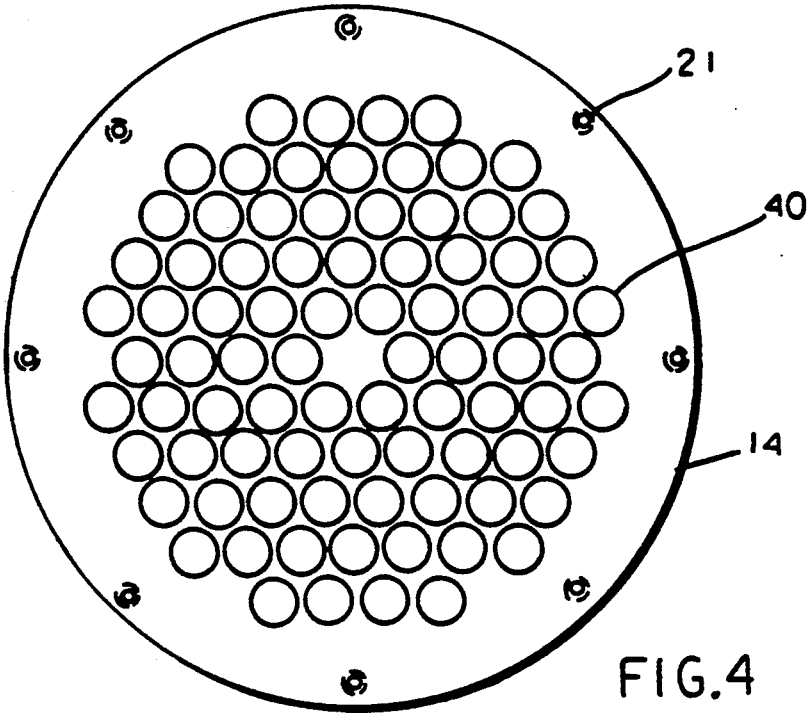
FIG. 4 is a top view of the evaporator.
Figure 5:
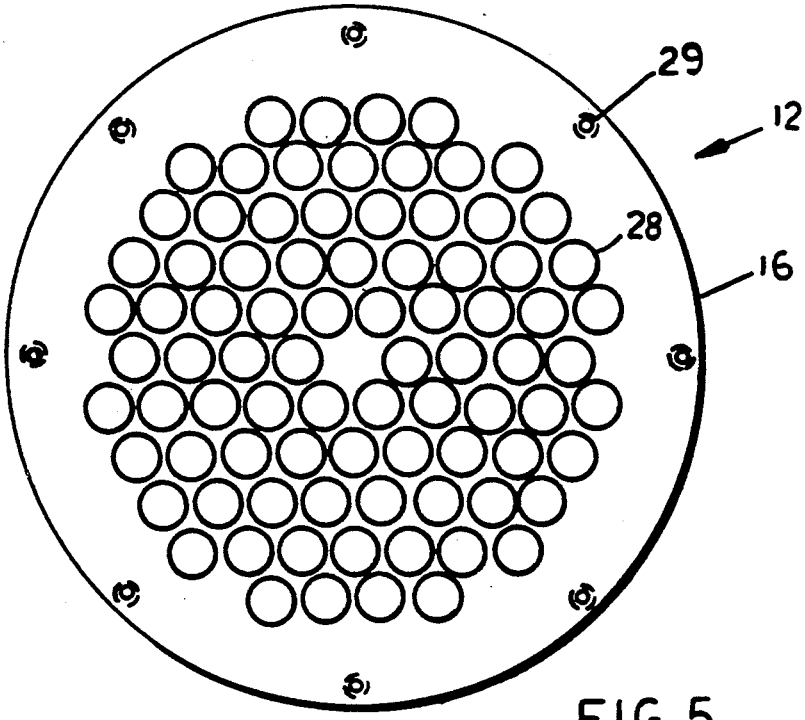
FIG. 5 is a bottom view of the evaporator.
Figure 6:
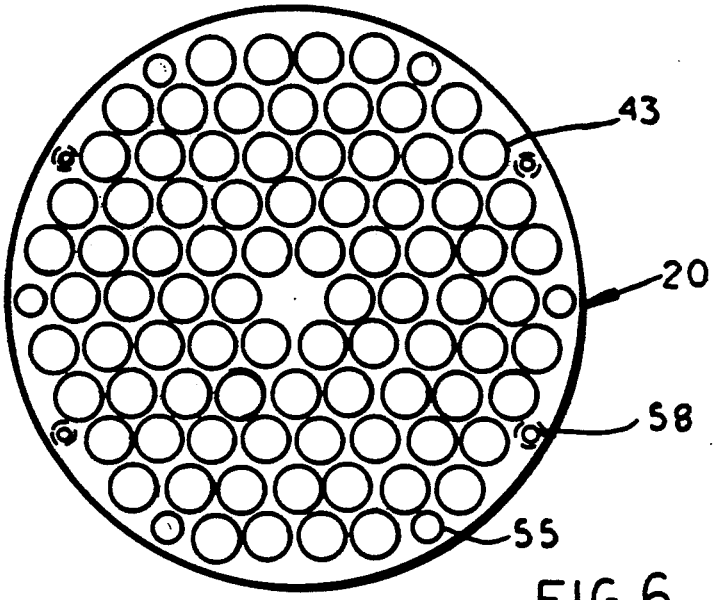
FIG. 6 is a top view of the lower baffle.
Figure 7:
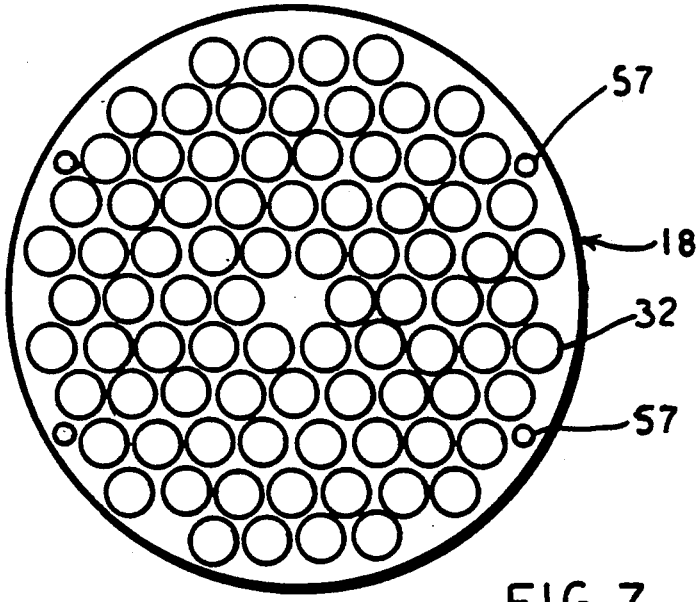
FIG. 7 is a top view of the upper baffle.

Top end 14 may be secured to enclosure 12 by bolts through top end bolt holes 21 as shown in FIG. 4. Bottom end 16 may be secured to enclosure 12 by bolts through bottom end bolt holes 29 shown in FIG. 5. Upper baffle 18 may be secured to enclosure 12 by bolts through upper baffle bolt holes 57 shown in FIG. 7. Lower baffle 20 may be secured to enclosure 12 by bolts through lower baffle bolt holes 58 shown in FIG. 6.

Figure 9:
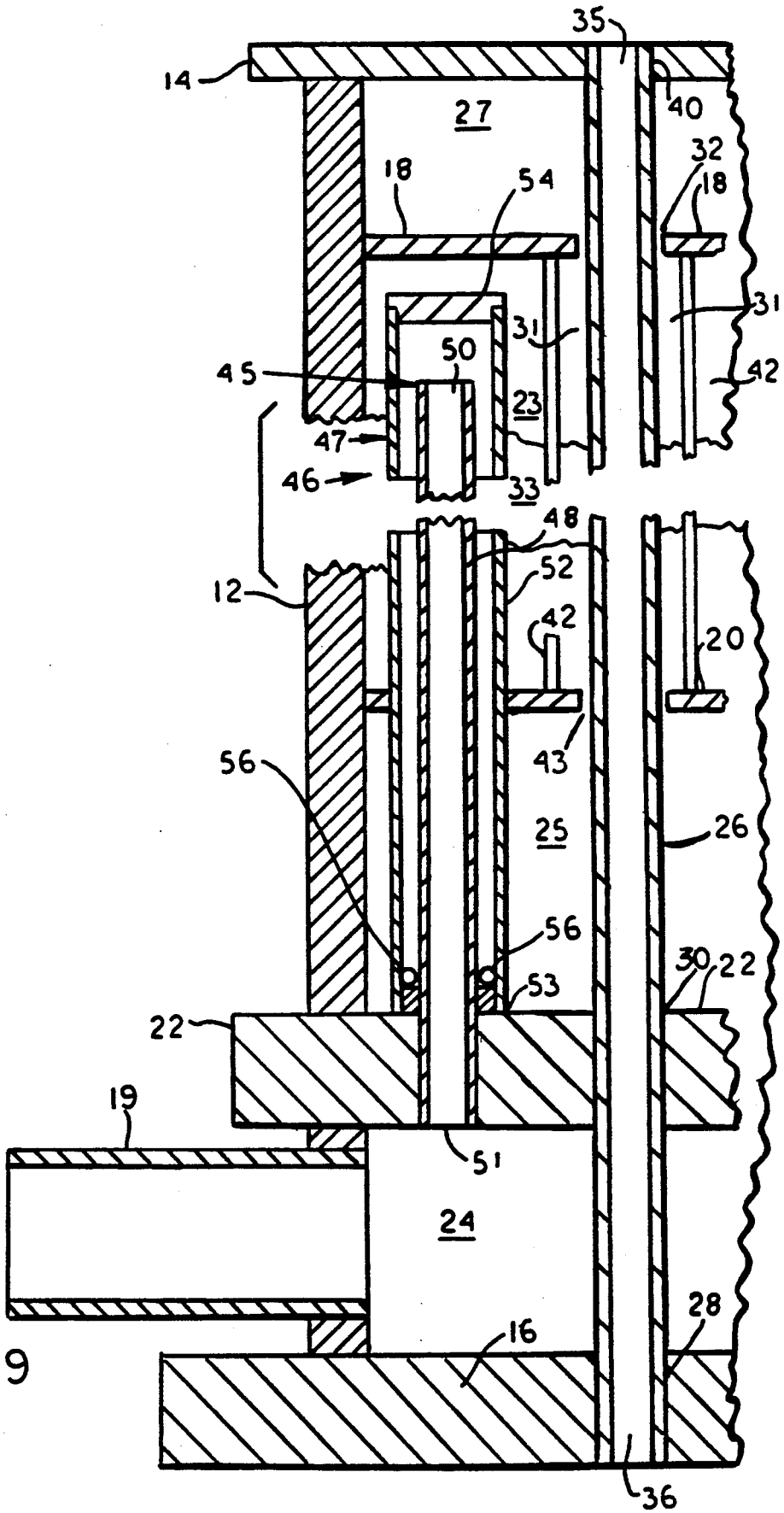
FIG. 9 is an enlarged partial cross sectional view taken on line 9—9 of FIG. 2 showing the structure of the standpipe embodiment with the pipes inside the enclosure.

In an internal standpipe system as shown in FIGS. 3 and 9, internal standpipes 47 consist of inner vertical pipe 48, that has open lower end 51, which extends from hot gas chamber 24 upwardly through standpipe holes 53 in separator plate 22 into freezing chamber 23, through standpipe holes 55 in lower baffle 20, and continues upwardly to a point above liquid refrigeration level 38 in enclosure 12. Inner vertical pipe 48 terminates in upper end 50 that is higher than liquid refrigeration level 38. Outer vertical pipe 52 is disposed exterior to inner vertical pipe 48, has closed upper end 54, and extends downwardly through lower baffle 20 and terminates at separator plate 22 at lower end 53 of outer vertical pipe 52. At or adjacent to lower end 53 of outer vertical pipe 52 an opening or port 56 opens to freezing chamber 23. Thus, a path is provided for the hot gas from hot gas chamber 24 to freezing chamber 23 while liquid refrigerant 37 is prevented from flowing into hot gas chamber 24 by the position of upper end 50 of inner vertical pipe 48 above liquid refrigerant level 38.

The internal standpipes 47 may be distributed throughout the freezing chamber as shown in FIG. 3.

Figure 13:
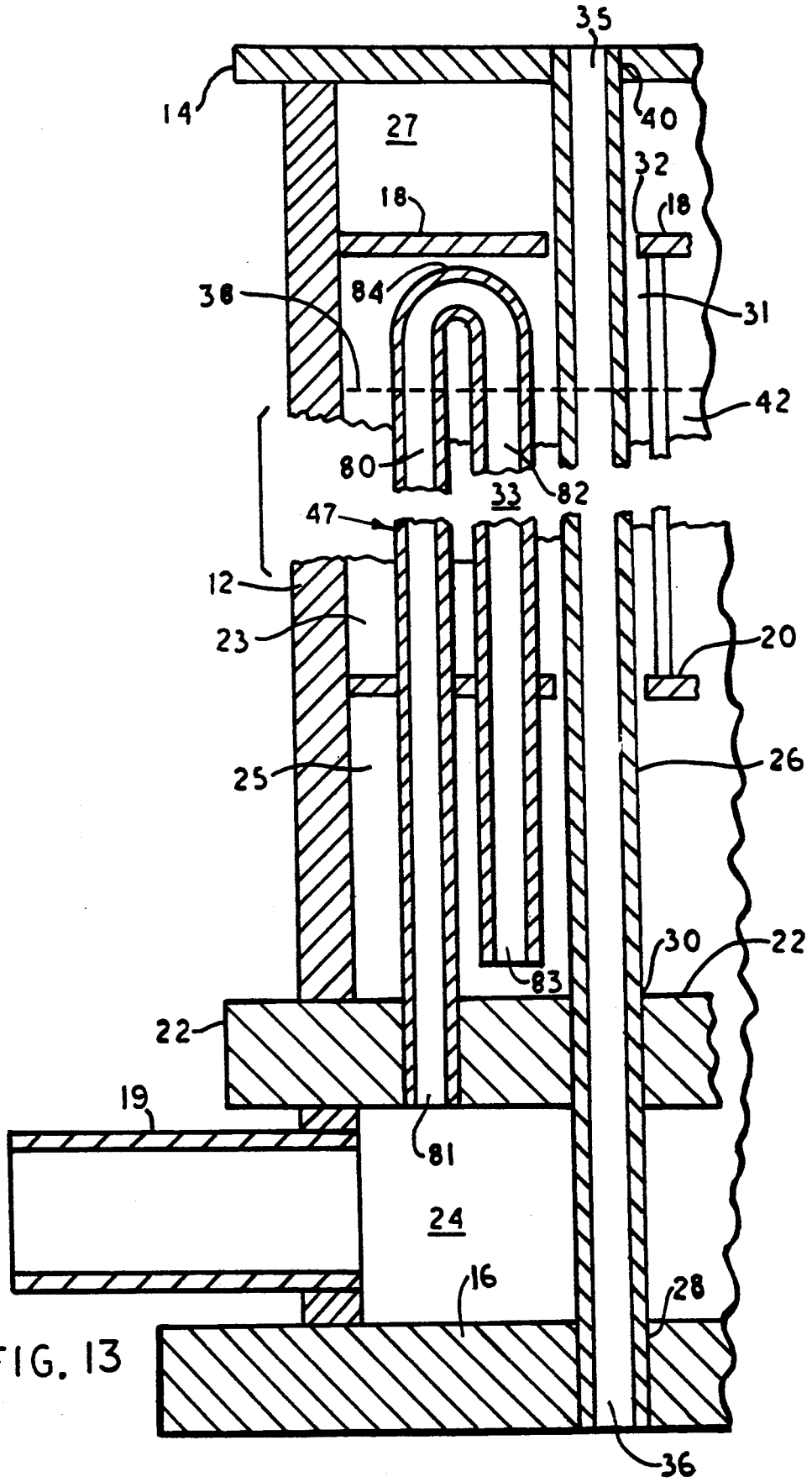
FIG. 13 is an enlarged partial cross sectional view of the structure of an alternative embodiment of the standpipe with the pipes inside the enclosure taken on line 9—9 of FIG. 2.

In an alternative embodiment as shown in FIG. 13, internal standpipes 47 may consist of one continuous pipe bent to form the path from hot gas chamber 24 through separator plate 22 to a point or upper end 84 above the effective liquid refrigerant level 38 and then downwardly to a point or lower end 83 near the bottom of freezing chamber 23.

Figure 14:
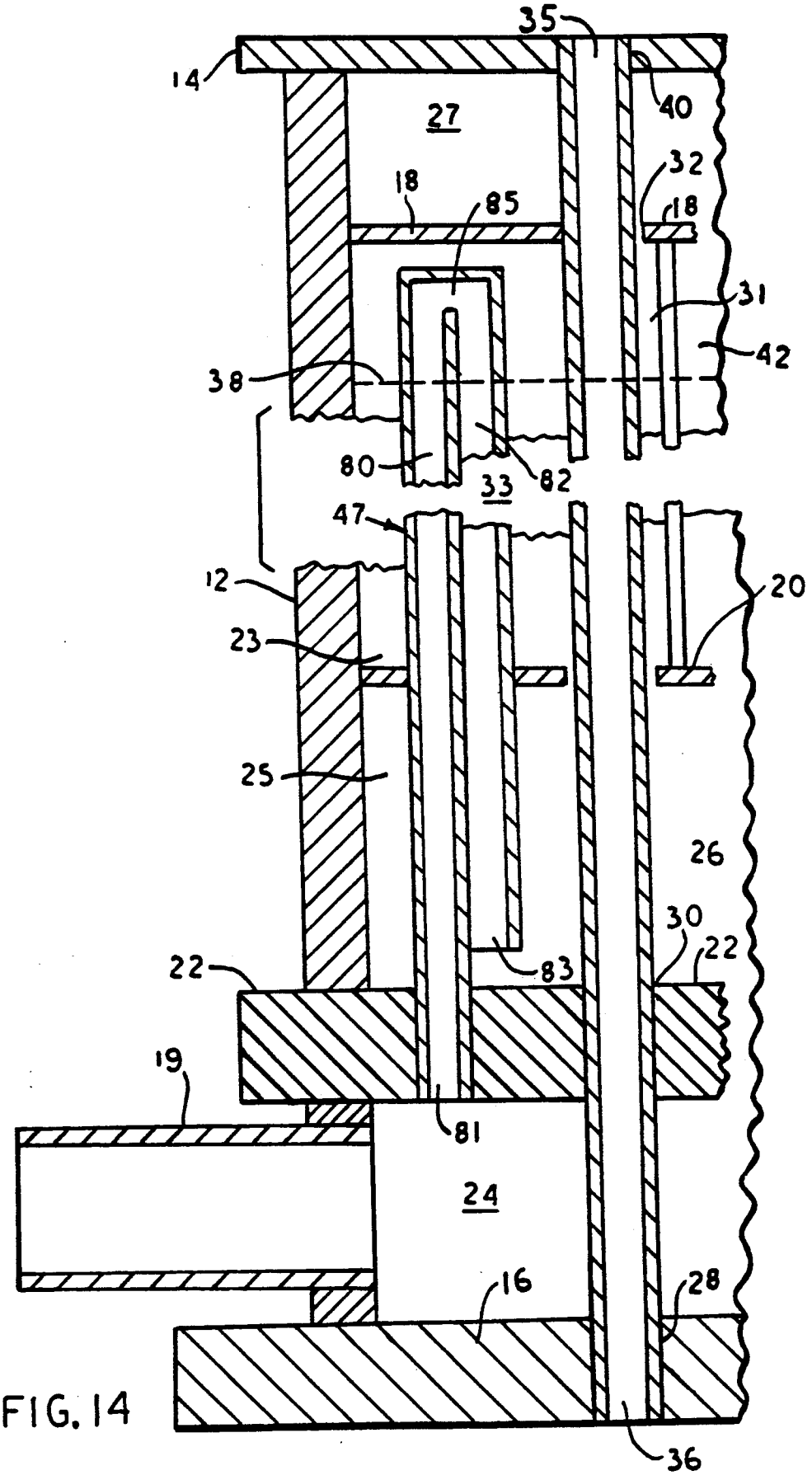
FIG. 14 is an enlarged partial cross sectional view of the structure of another alternative embodiment of the standpipe with the pipes inside the enclosure taken on line 9—9 of FIG. 2.

In another alternative embodiment, internal standpipes 47 may consist of a riser pipe 80 and a drop pipe 82 connected at their upper ends by an open area 85, as shown in FIG. 14.

In FIGS. 13 and 14, riser pipe 80 has lower open end 81 in hot gas chamber 24. Riser pipe 80 extends upwardly through separator plate 22 into the freezing chamber 23, through lower baffle 20 and continues upwardly to a point above an effective liquid refrigerant level 38 in enclosure 12. Drop pipe 82 extends from a point above the effective liquid refrigerant level 38 downwardly through lower baffle 20 into refrigerant receiving area 25 with open lower end 83 adjacent separator plate 22. The upper ends of pipes 80 and 82 may be connected by a tube 84 as shown in FIG. 13. In the alternative, pipes 80 and 82 may be sealed together with an open area 85 therebetween for the passage of gas as shown in FIG. 14. Thus a path is provided for the hot gas from hot gas chamber 24 to freezing chamber 23 while liquid refrigerant is prevented from flowing into hot gas chamber 24 by the position of the upper ends of pipes 80 and 82 above the effective liquid refrigerant level 38.

In an external standpipe system as shown in FIG. 10, external pipes 49 each consist of first pipe 60, second pipe 62 and bridge pipe 68. Each first pipe 60 has lower end 64 that is open to hot gas chamber 24 through the outer wall of enclosure 12. First pipe 60 extends upwardly exterior to enclosure 12 to a point above liquid refrigerant level 38 in enclosure 12. Each second pipe 62 has lower end 66 that is open to freezing chamber 23 through the outer wall of enclosure 12 adjacent separator plate 22. Second pipe 62 extends upwardly exterior to enclosure 12 to a point above liquid refrigerant level 38 in enclosure 12. Bridge pipe 68 connects first pipe 60 to second pipe 62 forming a path for the hot gas from hot gas chamber 24 to freezing chamber 23 while liquid refrigerant 37 is prevented from flowing into hot gas chamber 24 by the position of the upper ends of first pipe 60 and second pipe 62 above liquid refrigerant level 38.

In an alternative embodiment, external standpipes 49 may consist of one continuous pipe bent to form the path from hot gas chamber 24 to a point above liquid refrigerant level 38 and then downwardly to a point near the bottom of freezing chamber 23.

In an internal check valve system as shown in FIG. 11, one or more ports are provided in separator plate 22. Each port being open to hot gas chamber 24 and freezing chamber 23. Internal check valve 70 is lodged in each port to permit flow only from hot gas chamber 24 to freezing chamber 23. Thus, a path is provided for the hot gas from hot gas chamber 24 to freezing chamber 23 while liquid refrigerant 37 is prevented from flowing into hot gas chamber 24 by check valve 70.

Figure 12:
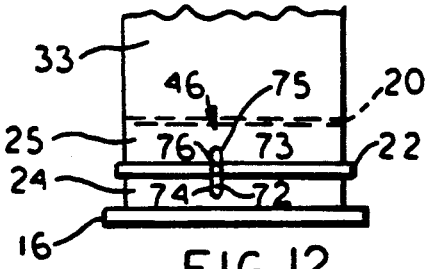
FIG. 12 is a front view of the invention showing the external check valve embodiment of the invention.

In an external check valve system as shown in FIG. 12, external conducting means 46 each consist of first pipe 72 having lower end 74 that is open to hot gas chamber 24 through the outer wall of enclosure 12 and a second pipe 73 that has upper end 75 that is open to freezing chamber 23 through the outer wall of enclosure 12 adjacent separator plate 22. First pipe 72 and second pipe 73 each connect to check valve 76 forming a path for the hot gas to flow from hot gas chamber 24 to freezing chamber 23 while liquid refrigerant 37 is prevented from flowing into hot gas chamber 24 by check valves 76.

The check valves shown in FIGS. 11 and 12, as well as the standpipes of FIGS. 9 and 10, act as selective flow means in that they determine the direction of the flow of refrigerant 34.

During the freezing cycle, refrigerant flows from refrigerant inlet 13 into refrigerant receiving chamber 25 of freezing chamber 23 through third holes 43 in lower baffle 20 into freezing area 33 of freezing chamber 23. Refrigerant in freezing area 33 flows between water pipes 26 and filler rods 42, out through fourth holes 32 in upper baffle 18 into refrigerant outlet area 27. Filler rods 42 direct refrigerant 34 in pathways 31 adjacent water pipes 26. Refrigerant, flowing through pathways 31, picks up the heat from the water in water pipes 26 forming ice. Refrigerant outlet area 27 collects refrigerant at the top of enclosure 12 and the refrigerant exits through refrigerant outlet 17.

During the harvest cycle, hot gas is directed into hot gas chamber 24 through hot gas inlet 19, flows up through standpipes 48 and out through open upper ends 50 into pipes 52 and out through ports 56 into refrigerant receiving area 25, through third holes 43 in lower baffle 20 around water pipes 26, into freezing chamber 23, through pathways 31, between water pipes 26 and filler rods 42 to upper baffle 18 and then through fourth holes 32 in upper baffle 18 into refrigerant outlet area 27, and through refrigerant outlet area 27 to refrigerant outlet 17. Thus, the hot gas warms water pipes 26 to release the ice which then drops out of water pipe outlet ends 36.

The evaporator of the present invention has two distinct separate sections. An upper section being freezing chamber 23 which is used to make ice. The lower section or hot gas chamber 24 is only used to facilitate the harvesting of ice.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A refrigeration evaporator comprising an enclosure, having a top end and a bottom end;

a separator plate adjacent said bottom end defining a hot gas chamber below said separator plate and a freezing chamber above said separator plate;

a refrigerant inlet connected to said enclosure above said separator plate;

a refrigerant outlet connected to said enclosure adjacent said top edge;

water pipes extending through said top end, through said freezing chamber, through said separator plate, thorugh said hot gas chamber and through said bottom end;

said water pipes having inlet ends adjacent said top end and outlet ends adjacent said bottom end;

a hot gas inlet connected to said hot gas chamber to admit hot gas to said hot gas chamber during a harvest cycle;

conducting means for conducting said hot gas from said hot gas chamber to said freezing chamber during said harvest cycle;

said conducting means being a stand pipe having an inlet end open to said hot gas chamber and having an outlet end open to said freezing chamber; and, preventing means for preventing liquid refrigerant from flowing from said freezing chamber into said hot gas chamber during a freezing cycle, said preventing means being a portion of said stand pipe extending upwardly to a point above an effective liquid refrigerant level in said freezing chamber.

2. The refrigeration evaporator recited in claim 1 wherein said conducting means comprises an internal standpipe;

said internal standpipe comprising a pipe extending through said separator plate into said freezing chamber and extending upwardly to a point above an effective liquid refrigerant level in said freezing chamber whereby said liquid refrigerant is prevented from flowing from said freezing chamber into said hot gas chamber;

said pipe further extending downwardly and being open to said freezing chamber adjacent said separator plate whereby said hot gas is provided from said hot gas chamber through said pipe to said freezing chamber.

3. The refrigeration evaporator recited in claim 1 wherein said conducting means comprises an internal standpipe;

said internal standpipe comprising an inner pipe extending through said separator plate into said freezing chamber and an outer pipe disposed exterior to said inner pipe;

said outer pipe having a closed upper end;

said inner pipe being open to said outer pipe at a point above said effective liquid refrigerant level in said freezing chamber whereby said liquid refrigerant is prevented from flowing from said freezing chamber into said hot gas chamber;

said outer pipe being open to said freezing chamber adjacent said separator plate whereby said hot gas is provided from said hot gas chamber through said inner and outer pipes to said freezing chamber.

4. The refrigeration evaporator recited in claim 2 further comprising a plurality of said internal standpipes; and said internal standpipes being distributed throughout said freezing chamber.

5. The refrigeration evaporator recited in claim 1 wherein said conducting means comprises an external standpipe;

said external standpipe comprising a pipe having an ascending portion and a descending portion;

said ascending portion extending from said hot gas chamber through said enclosure and then extends generally upwardly to a point above an effective refrigerant level;

said descending portion extending downwardly from said point above the effective refrigerant level to a point adjacent said separator plate and then extends through said enclosure into said freezing chamber whereby said path for said hot gas is provided from said hot gas chamber to said freezing chamber; and, said liquid refrigerant is prevented from flowing from said freezing chamber into said hot gas chamber.

6. The refrigeration evaporator recited in claim 5 further comprising a plurality of said external standpipes; and, said external standpipes being distributed around said enclosure.

7. The refrigeration evaporator recited in claim 1 wherein said conducting means and said preventing means comprises an external check valve system;

said external check valve system comprising a first pipe, a second pipe and a check valve;

said first pipe extending from said hot gas chamber through said enclosure and extends generally upwardly therefrom;

said second pipe extending from said freezing chamber through said enclosure at a point adjacent said separator plate and extends generally downwardly therefrom;

said check valve joins said first pipe and said second pipe whereby said path for said hot gas is provided from said hot gas chamber to said freezing chamber; and, said liquid refrigerant is prevented from flowing from said freezing chamber into said hot gas chamber.

8. The refrigeration evaporator recited in claim 7 further comprising a plurality of external check valves; and, said check valves being distributed around said enclosure.

9. The refrigeration evaporator recited in claim 1 further comprising an upper baffle and a lower baffle;

said lower baffle spaced above said separator plate and said upper baffle spaced below said top end of said enclosure, holes in said upper baffle and holes in said lower baffle;

said water pipes extending through said upper baffle and through said lower baffle; and, said refrigerant passing through said holes in said upper baffle and through said holes in said lower baffle.

10. The refrigeration evaporator recited in claim 9 wherein said holes in said upper baffle are larger than said holes in said lower baffle whereby the pressure drop of said refrigerant through said evaporator is reduced.

11. A refrigeration evaporator comprising an enclosure, having a top end and a bottom end;

a separator plate adjacent said bottom end defining a hot gas chamber below said separator plate and a freezing chamber above said separator plate;

a refrigerant inlet connected to said enclosure above said separator plate;

a refrigerant outlet connected to said enclosure adjacent said top end;

water pipes extending through said top end, through said freezing chamber, through said separator plate, through said hot gas chamber and through said bottom end;

said water pipes having inlet ends adjacent said top end and outlet ends adjacent said bottom end;

a hot gas inlet connected to said hot gas chamber to admit hot gas to said hot gas chamber during a harvest cycle;

conducting means for conducting said hot gas from said hot gas chamber to said freezing chamber during said harvest cycle;

preventing means for preventing liquid refrigerant from flowing from said freezing chamber into said hot gas chamber during a freezing cycle;

filler rods distributed throughout said enclosure between said water pipes;

support means supporting said filler rods in said freezing chamber;

said filler rods being spaced from said separator plate to allow distribution of refrigerant across said freezing chamber below said filler rods;

said filler rods terminating below said top end of said enclosure to allow exiting of refrigerant gas above said filler rods, whereby the volume of said refrigerant required to fill said freezing chamber is reduced and the velocity of said refrigerant through said freezing chamber is increased.

12. The refrigeration evaporator recited in claim 11 wherein said filler rods are made of a relatively high heat conducting material to increase heat transfer from said refrigerant to said water pipes.

13. The refrigeration evaporator recited in claim 11 wherein said filler rods and said water pipes are packed in said enclosure forming multiple vertical pathways around each said water pipe whereby refrigerant flow rate is increased and incidence of oil separation and entrapment is reduced.

14. The refrigeration evaporator recited in claim 11 wherein said support means comprises a lower baffle spaced above said separator plate and with said separator plate defining said refrigerant receiving chamber; and, said filler rods having lower ends disposed adjacent said lower baffle.

15. The refrigeration evaporator recited in claim 11 further comprising an upper baffle spaced below said top end of said enclosure and defining said refrigerant outlet area; and, said filler rods having upper ends disposed adjacent said upper baffle.

16. A refrigeration evaporator comprising an enclosure, having a top end and a bottom end;

a separator plate adjacent said bottom end defining a hot gas chamber below said separator plate and a freezing chamber above said separator plate;

a refrigerant inlet connected to said enclosure above said separator plate;

a refrigerant outlet connected to said enclosure adjacent said top end;

water pipes extending through said top end, through said freezing chamber, through said separator plate, through said hot gas chamber and through said bottom end;

said water pipes having inlet ends adjacent said top end and outlet ends adjacent said bottom end;

a hot gas inlet connected to said hot gas chamber to admit hot gas to said hot gas chamber during a harvest cycle;

conducting means for conducting said hot gas from said hot gas chamber to said freezing chamber during said harvest cycle;

preventing means for preventing liquid refrigerant from flowing from said freezing chamber into said hot gas chamber during a freezing cycle;

an upper baffle spaced below said top end of said enclosure and defining a refrigerant outlet area.

17. A refrigeration evaporator comprising an enclosure, having a top end and a bottom end;

a separator plate adjacent said bottom end defining a hot gas chamber below said separator plate and a freezing chamber above said separator plate;

a refrigerant inlet connected to said enclosure above said separator plate;

a refrigerant outlet connected to said enclosure adjacent said top end;

water pipes extending through said top end, through said freezing chamber, through said separator plate, through said hot gas chamber and through said bottom end;

said water pipes having inlet ends adjacent said top end and outlet ends adjacent said bottom end;

a hot gas inlet connected to said hot gas chamber to admit hot gas to said hot gas chamber during a harvest cycle;

conducting means for conducting said hot gas from said hot gas chamber to said freezing chamber during said harvest cycle;

preventing means for preventing liquid refrigerant from flowing from said freezing chamber into said hot gas chamber during a freezing cycle;

a lower baffle spaced above said separator plate and defining a refrigerant receiving chamber between said lower baffle and said separator plate.

18. A refrigeration evaporator comprising an enclosure, having a top end and a bottom end;

a freezing chamber in said enclosure;

a refrigerant inlet connected to said enclosure adjacent the bottom of a freezing chamber;

a refrigerant outlet connected to said enclosure adjacent said top end;

water pipes extending through said top end, through said freezing chamber, and through said bottom end;

said water pipes having inlet ends adjacent said top end and outlet ends adjacent said bottom end;

filler rods distributed throughout said enclosure between said water pipes;

support means supporting said filler rods in said freezing chamber;

said filler rods being spaced above said bottom of said freezing chamber to allow distribution of said refrigerant across said freezing chamber below said filler rods;

said filler rods terminating below said top end of said enclosure to allow exiting of said refrigerant gas above said filler rods whereby the volume of said refrigerant required to fill said freezing chamber is reduced and the velocity of said refrigerant through said freezing chamber is increased.

* * * * *